US008042496B2

(12) United States Patent
Min

(10) Patent No.: US 8,042,496 B2
(45) Date of Patent: Oct. 25, 2011

(54) HOT-WATER SUPPLY SYSTEM HAVING SUPPLEMENTARY HEAT EXCHANGER

(75) Inventor: Tae-Sik Min, Dongjak-gu (KR)

(73) Assignee: Kyungdong Navien Co., Ltd., Gyunggi-Do (KR)

( * ) Notice: Subject to any disclaimer, the term of this patent is extended or adjusted under 35 U.S.C. 154(b) by 791 days.

(21) Appl. No.: 11/885,613

(22) PCT Filed: Mar. 7, 2006

(86) PCT No.: PCT/KR2006/000777

§ 371 (c)(1), (2), (4) Date: Apr. 24, 2008

(87) PCT Pub. No.: WO2006/109926

PCT Pub. Date: Oct. 19, 2006

(65) Prior Publication Data

US 2008/0276884 A1 Nov. 13, 2008

(30) Foreign Application Priority Data

Mar. 7, 2005 (KR) ..... 10-2005-0018765

(51) Int. Cl.
*F24H 9/14* (2006.01)

(52) U.S. Cl. ..... 122/20 R; 122/13.3

(58) Field of Classification Search ..... 122/20 A, 122/20 R, 13.3, 15.1, 18.1; 137/592
See application file for complete search history.

(56) References Cited

U.S. PATENT DOCUMENTS

| | | | | |
|---|---|---|---|---|
| 2,875,596 | A * | 3/1959 | Justice | 62/482 |
| 4,175,518 | A * | 11/1979 | Reames, Jr. | 122/20 B |
| 4,300,536 | A * | 11/1981 | Taschuk | 126/615 |
| 4,344,568 | A * | 8/1982 | Stewart et al. | 237/8 R |
| 4,408,567 | A * | 10/1983 | Morton | 122/14.21 |
| 6,564,755 | B1 * | 5/2003 | Whelan | 122/20 B |
| 6,606,968 | B2 * | 8/2003 | Iwama et al. | 122/18.1 |
| 7,360,507 | B1 * | 4/2008 | Logsdon | 122/367.1 |
| 7,597,066 | B2 * | 10/2009 | Shimada et al. | 122/18.1 |
| 7,773,868 | B2 * | 8/2010 | Moore | 392/490 |

FOREIGN PATENT DOCUMENTS

| | | |
|---|---|---|
| JP | 2004-278983 | 10/2004 |
| KR | 10-2000-0059907 | 10/2000 |
| KR | 10-0296559 | 10/2001 |
| KR | 10-0437192 | 6/2004 |

OTHER PUBLICATIONS

International Search Report for Application No. PCT/KR2006/000777, dated May 26, 2006.

* cited by examiner

*Primary Examiner* — Gregory A Wilson

(74) *Attorney, Agent, or Firm* — Nelson Mullins Riley & Scarborough LLP; Anthony A. Laurentano

(57) ABSTRACT

Disclosed is a hot water supplying apparatus having an auxiliary heat exchanger. The hot water supplying apparatus comprises: a heat exchanger including an inlet pipe for introducing heating water into the heat exchanger, and first, second, and third heat exchanging pipes connected to the inlet pipe and sequentially arranged; and an auxiliary heat exchanging device installed at an inlet port of the heat exchanger through which the heating water is introduced, the auxiliary heat exchanging device including a first auxiliary heat exchanging pipe connecting the inlet pipe to the first heat exchanging pipe, a second auxiliary heat exchanging pipe connecting the second heat exchanging pipe to the third heat exchanging pipe, and heat transfer fins for transferring heat energy from the second auxiliary heat exchanging pipe to the first auxiliary heat exchanging pipe.

2 Claims, 2 Drawing Sheets

HOT-WATER SUPPLY SYSTEM HAVING SUPPLEMENTARY HEAT EXCHANGER

TECHNICAL FIELD

The present invention relates to a hot water supplying apparatus having an auxiliary heat exchanger, and more particularly to a hot water supplying apparatus, which includes an auxiliary heat exchanger capable of preheating introduced calefactory water in order to prevent the creation of corrosion of pipe due to condensation at an inlet port of a heat exchanger through which the calefactory water is introduced.

BACKGROUND ART

In general, a heat exchanging apparatus provided to an apparatus for supplying hot water is to absorb combustion heat generated from a burner, and includes heat exchanging pipes through which water flows and heat transferring fins for absorbing the combustion heat, so as to heat water using the combustion heat in order to make hot water.

FIG. 1 is a schematic view showing the structure of a conventional gas powered boiler.

In a heat exchanging apparatus 1, heat energy generated by a burner 20 is transferred to a heat exchanger 10 including a first heat exchanging pipe 11*a* so as to heat water in the heat exchanger 10. The hot calefactory water is forcibly supplied to locations which require heating by a circulation pump (not shown), so as to transfer heat energy. At this time, a blower 30 is installed at a lower portion of the burner 20 in order to effectively transfer heat energy to the heat exchanger 10. Meanwhile, exhaust gas is discharged outside through a smoke tube 40.

The calefactory water circulated by the circulation pump transfers its heat to the locations which require heating, and then returns to the relatively cold water so as to be introduced through the inlet into the heat exchanger 1. This process is repeated, so that the calefactory water is continuously circulated.

In the gas powered boiler having the above mentioned structure, since water in a pipe for heating water rises in temperature and there occurs no temperature difference between external air and the heating water during the operation of the boiler, there occurs no condensate water at the inlet pipe 50 for the heat exchanger which is installed at an inlet port through which the heating water is introduced into the heat exchanging apparatus 1.

In the boiler having the above mentioned structure, when much time passes in the state that the operation of the boiler stops, all of pipes in the boiler, the heat exchanger, pipes connected from the boiler to rooms respectively, and pipes arranged in the rooms are fully filled with cool water of which temperature has dropped. Further, the temperature of water in the pipes for heating becomes lowered to level identical with temperature of air around the boiler.

When the boiler operates in a state that the temperature of the water in the heating pipe is low, there occurs temperature difference between the cool water in the heating pipe and the air heated by the combustion of the burner.

Such a temperature difference seriously occurs in winter when a temperature of water in heating pipes is very low. Moisture, which is contained in the atmosphere, is condensed on a peripheral surface of pipes of the heat exchanger, so as to be condensate water.

Since high temperature heat is directly transferred from the burner 20 to the heat exchanger 10 which includes a plurality of heat exchanging pipes installed therein, no water condenses on the heat exchanger. However, moisture contained in the atmosphere condenses on the peripheral surface of the inlet pipe 50 arranged at the inlet port of the heat exchanger through which the calefactory water is introduced, and the first heat exchanging pipe 11*a* because of the temperature difference between the cold water in the pipes and the external air. Such condensate water accelerates the corrosion of various parts, made of metal material, of the boiler.

DISCLOSURE OF INVENTION

Technical Problem

Accordingly, the present invention has been made to solve the above-mentioned problems occurring in the prior art, and an object of the present invention is to provide a hot water supplying apparatus having an auxiliary heat exchanger which can transfer heat energy from hot water within a heat exchanging pipe heated by combustion heat of a burner to an inlet port of a heat exchanger into which cold water is introduced at an initial operation of a boiler, thereby preventing the creation of condensate water at an inlet port of the heat exchanger through which calefactory water is introduced and the corrosion of parts.

Technical Solution

In order to accomplish the object of the present invention, there is provided a hot water supplying apparatus, which comprises: a heat exchanger including an inlet pipe for introducing heating water into the heat exchanger, and first, second, and third heat exchanging pipes connected to the inlet pipe and sequentially arranged; and an auxiliary heat exchanging device installed at an inlet port of the heat exchanger through which the heating water is introduced, the auxiliary heat exchanging device including a first auxiliary heat exchanging pipe connecting the inlet pipe to the first heat exchanging pipe, a second auxiliary heat exchanging pipe connecting the second heat exchanging pipe to the third heat exchanging pipe, and heat transfer fins for transferring heat energy from the second auxiliary heat exchanging pipe to the first auxiliary heat exchanging pipe.

Advantageous Effects

The hot water supplying apparatus having an auxiliary heat exchanger according to the present invention, is provided with an auxiliary heat exchanger for raising the temperature of cold water which is introduced through an inlet pipe installed at an inlet port of the heat exchanger, thereby preventing the creation of the condensate water and the corrosion of the parts of a boiler.

BRIEF DESCRIPTION OF THE DRAWINGS

The above and other objects, features and advantages of the present invention will be more apparent from the following detailed description taken in conjunction with the accompanying drawings, in which.

BEST MODE FOR CARRYING OUT THE INVENTION

Hereinafter, the structure and operation of a hot water supplying apparatus according to the present invention will be described in detail with reference to the accompanying drawings.

Figure 1:
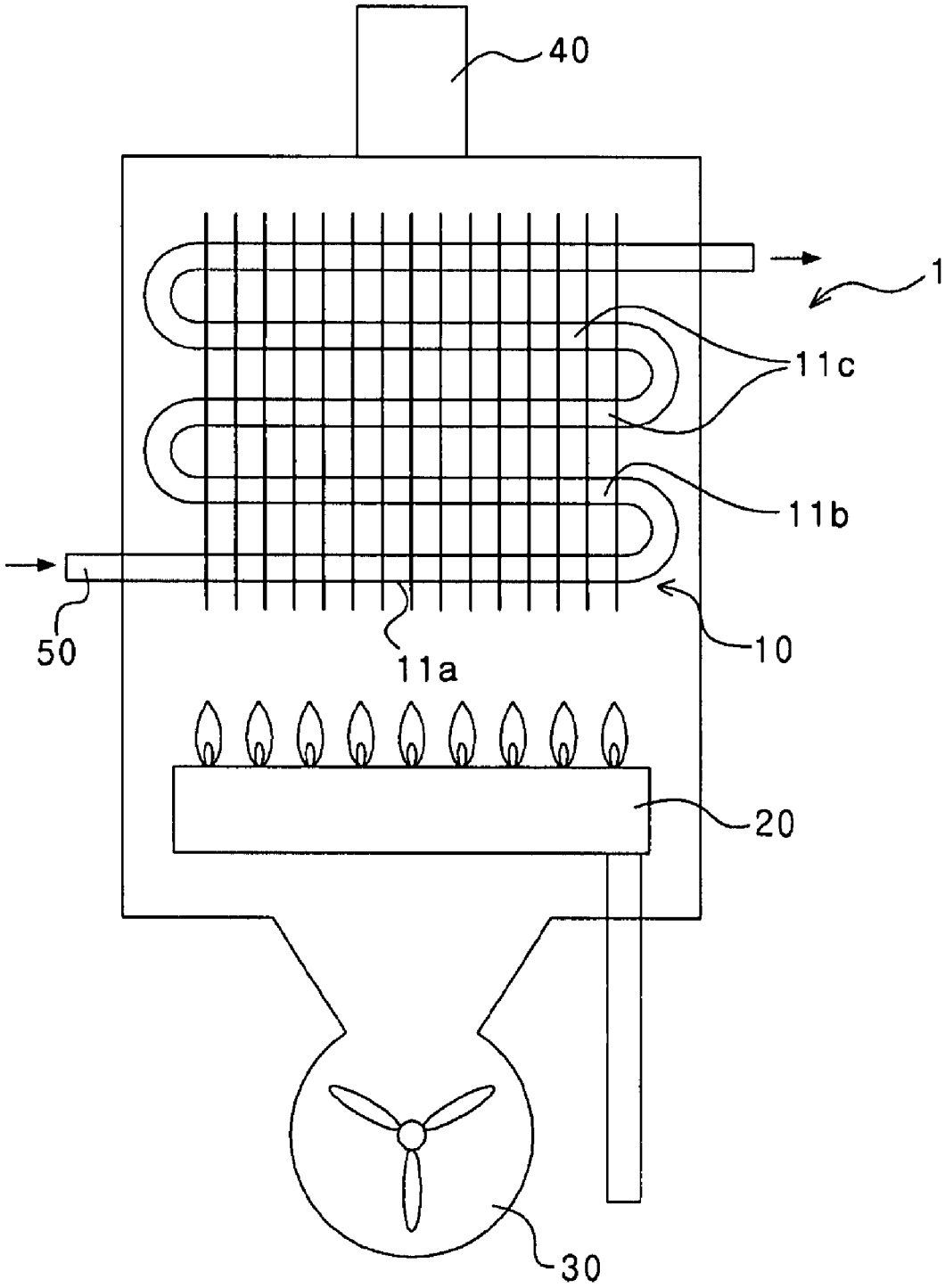
FIG. 1 is a schematic view showing the structure of a heat exchanger in a conventional gas boiler.
Figure 2:
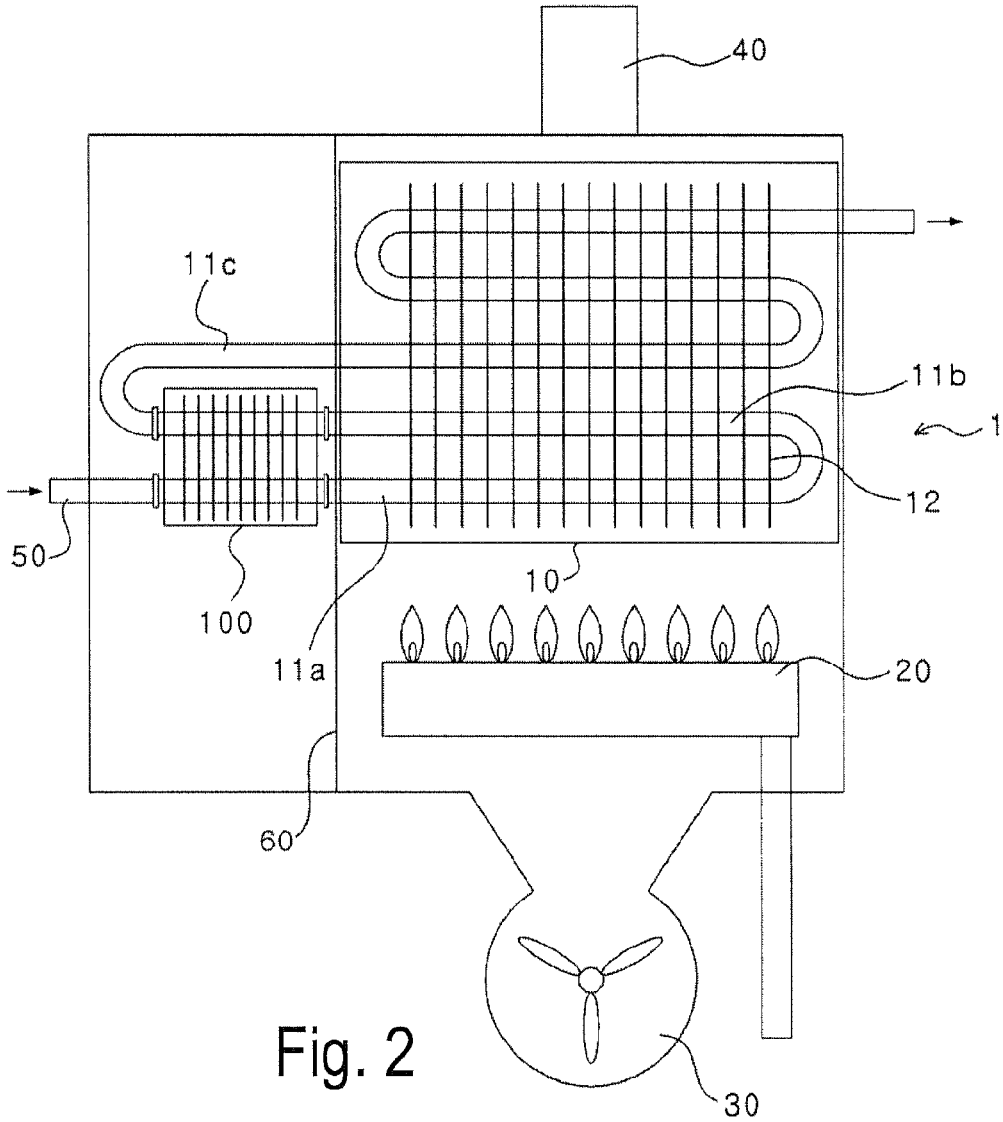
FIG. 2 is a schematic view showing a hot water supplying apparatus including an auxiliary heat exchanger according to an embodiment of the present invention.
Figure 3:
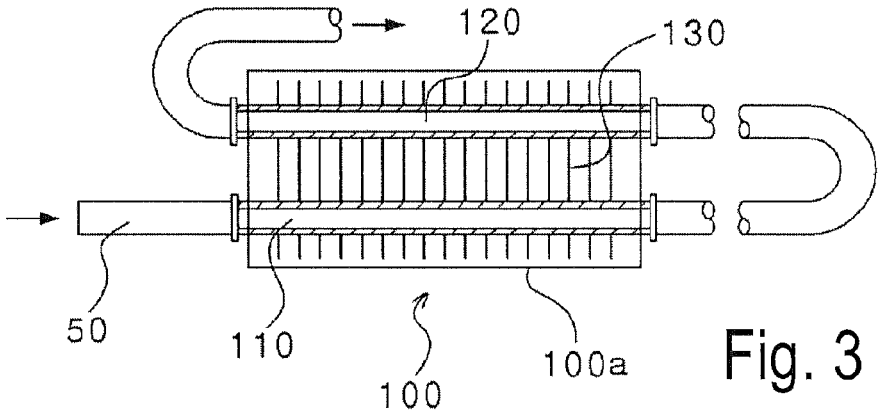
FIG. 3 is a detailed view of the auxiliary heat exchanger of FIG. 2.

FIG. 2 is a schematic view showing a hot water supplying apparatus including an auxiliary heat exchanger according to an embodiment of the present invention.

An inlet pipe 50 for a heat exchanger is installed at an inlet port of the heat exchanger 1 into which returned calefactory water, having finished a transfer of heat at a locations which require heating, is introduced.

A burner 20 is provided on the upper portion of a blower 30, on which a heat exchanging section 10 including a plurality of heat exchanging pipes connected to the inlet pipe 50 for the heat exchanger is arranged, so as to transfer heat energy from the burner 20 to calefactory water in the heat exchanging pipes.

The heat exchanging section 10 has a plurality of heat exchanging pipes including first, second, and third heat exchanging pipes 11*a*, 11*b*, and 11*c* sequentially arranged, and heat transferring pins 12.

The first heat exchanging pipe 11*a* should be connected to the inlet pipe 50 for the heat exchanger, but in the present invention, an auxiliary heat exchanger 100 is disposed between the first heat exchanging pipe 11*a* and the inlet pipe 50 for the heat exchanger.

The auxiliary heat exchanger 100 includes a first auxiliary heat exchanging pipe 110 connecting the first heat exchanging pipe 11*a* to the inlet pipe 50 for the heat exchanger, a second auxiliary heat exchanging pipe 120 connecting the second heat exchanging pipe 11*b* to the third heat exchanging pipe 11*c*, and heat transfer fins 130 for transferring heat energy of heating water, which flows in the second auxiliary heat exchanging pipe 120, to the first auxiliary heat exchanging pipe 110. Here, the first auxiliary heat exchanging pipe 110 and the second auxiliary heat exchanging pipe 120 and the heat transfer fins 130 are enclosed by an enclosure 100*a* of the auxiliary heat exchanger 100. Also, the auxiliary heat exchanger 100 is insulated against heat transfer from a burner 20 by a shielding wall 60.

The calefactory water, which receives the heat energy generated from the burner 20 in the heat exchanger 1 and which has already been heated so as to be hot, is forcibly supplied to each location which requires heating by a circulation pump (not shown). Then, after the completion of the heat exchange, the heating water becomes warm water, so as to be introduced through the inlet pipe 50 into the heat exchanger 1. These processes are repeated, so that the heating water is continuously circulated.

When the boiler stops its operation after these processes are performed, cold water is fully filled within each pipe. In this state, when the boiler is operated again, cold water is supplied through the inlet pipe 50 to the heat exchanger 1.

The cold water, which is supplied through the inlet pipe 50 of the heat exchanger 1, sequentially passes through the first auxiliary heat exchanging pipe 110, the first heat exchanging pipe 11*a*, and the second heat exchanging pipe 11*b*, while absorbing the heat energy from combustion heat of the burner 20 so as to be heated.

The heating water which is heated as described above passes through the second auxiliary heat exchanging pipe 120. At this time, the heat energy is transferred through the heat transfer fins 130 from the heating water in the second auxiliary heat exchanging pipe 120 to the cold water in the first auxiliary heat exchanging pipe 110. The cold water in the first auxiliary heat exchanging pipe 110, which receives the heat energy as described above, raises in temperature so as to decrease temperature difference between external air and the cold water, thereby preventing the creation of condensate water.

After sequentially passing through the second auxiliary heat exchanging pipe 120, the third heat exchanging pipe 11*c*, and a plurality of pipes, the heat water is forcibly supplied to locations which require heating and then performs heating.

Although the embodiment of the present invention is described with respect to an upstream type gas boiler, it is obvious to a person skilled in the art that the above-mentioned auxiliary heat exchanger can be applied to a downstream type gas boiler and the present invention can be applicable for a hot water supplying apparatus.

INDUSTRIAL APPLICABILITY

As described above, the present invention is applicable for the apparatuses of supplying hot water as well as the boiler so as to raise the temperature of the cold water introduced through the water inlet pipe, thereby presenting the creation of the condensation water and the corrosion of parts of the hot water supplying apparatus.

The invention claimed is:

1. A hot water supplying apparatus, comprising:

a heat exchanger including an inlet pipe for introducing heating water into the heat exchanger, and first, second, and third heat exchanging pipes connected to the inlet pipe and sequentially arranged; and an auxiliary heat exchanging device installed at an inlet port of the heat exchanger through which the heating water is introduced, the auxiliary heat exchanging device including a first auxiliary heat exchanging pipe connecting the inlet pipe to the first heat exchanging pipe, a second auxiliary heat exchanging pipe connecting the second heat exchanging pipe to the third heat exchanging pipe, and heat transfer fins for transferring heat energy from the second auxiliary heat exchanging pipe to the first auxiliary heat exchanging pipe, wherein the first auxiliary heat exchanging pipe and the second auxiliary heat exchanging pipe and the heat transfer fins are enclosed inside the auxiliary heat exchanging device, and wherein the auxiliary heat exchanging device is insulated against heat transfer from a burner by a shielding wall.

2. The hot water supply apparatus of claim 1, wherein the second auxiliary heat exchanging pipe is directly connected to the second heat exchanging pipe at one end and directly connected to the third heat exchanging pipe at an opposite end.

* * * * *